United States Patent [19]

Bergh et al.

[11] 4,170,080

[45] Oct. 9, 1979

[54] EXPANDED COMPOSITE PICTURE FRAME

[75] Inventors: George G. Bergh; Robert G. Bergh, both of Plainville, Mass.

[73] Assignee: Bergh Bros. Co., Inc., Attleboro, Mass.

[21] Appl. No.: 884,833

[22] Filed: Mar. 9, 1978

[51] Int. Cl.[2] ..... G09F 1/12

[52] U.S. Cl. ..... 40/152

[58] Field of Search ..... 40/152, 156, 155, 10 R

[56] References Cited

U.S. PATENT DOCUMENTS

| | | | |
|---|---|---|---|
| 2,538,386 | 1/1951 | Schneider | 40/152 |
| 2,623,316 | 12/1952 | Knox | 40/152 |
| 3,205,599 | 9/1965 | Spertus | 40/152 |
| 3,916,549 | 11/1975 | Storch et al. | 40/156 |
| 4,041,632 | 8/1977 | Sarkisian | 40/156 |

*Primary Examiner*—Louis G. Mancene
*Assistant Examiner*—Wenceslao J. Contreras
*Attorney, Agent, or Firm*—Thompson, Birch, Gauthier & Samuels

[57] ABSTRACT

An expanded composite picture frame having inner and outer channel-shaped frame components held in mutually spaced relationship by an intermediate filler piece. The inner frame component supports the picture and is mechanically interlocked to the inner edge of the filler piece. The outer frame component firmly grips and decoratively overlaps the outer edge of the filler piece.

7 Claims, 4 Drawing Figures

EXPANDED COMPOSITE PICTURE FRAME

BACKGROUND OF THE INVENTION

1. Field of the Invention

This invention relates generally to picture frames, and in particular to an improved expanded composite picture frame.

2. Description of the Prior Art

As herein employed, the term "composite picture frame" is intended to define a picture frame having inner and outer frame components directly interlocked with one another. Prior art examples of such picture frames are illustrated in U.S. Pat. Nos. 2,651,867 (Prew), 3,408,759 (Rotheraine et al) and 3,579,886 (Hughes). The purpose of the outer frame component is primarily decorative, its function being to provide an ornamental border around the inner frame component. There are limits, however, to the widths of the ornamental borders which can be achieved with this technique. Expanded composite picture frames were developed in order to overcome this problem. The term "expanded composite picture frame" is intended herein to define a picture frame having inner and outer frame components held in a mutually spaced or expanded relationship by an intermediate filler piece. An example of a prior art expanded composite picture frame is illustrated in U.S. Pat. No. 2,623,316 (Knox). The Knox arrangement provides a wide decorative border around the inner frame component, with the majority of the border width being supplied by the relatively inexpensive filler piece. This represents a decided cost advantage as compared to composite picture frames having wide outer frames which are more expensive and difficult to manufacture.

Thus far, however, the potential advantages of expanded composite picture frames have not been fully realized due to a number of problems including lack of structural rigidity and difficulty of assembly.

SUMMARY OF THE INVENTION

An object of the present invention is the provision of an improved expanded composite picture frame which obviates the problems noted above.

A more specific object of the present invention is the provision of an expanded composite picture frame which is structurally rigid and easy to assemble.

In a preferred embodiment to be hereinafter described in greater detail, these as well as other objects and advantages are achieved by providing an expanded composite picture frame having an inner first frame component surrounding a display opening, the said first frame component having a channel-shaped cross-section formed by a first side wall with parallel first flanges extending inwardly therefrom. Conventional means, including a front transparent protective panel of glass, plexiglass or the like and a back insert panel cooperate with the first frame component to retain a picture in the display opening. An outer second frame component surrounds the first frame component. The second frame component is likewise provided with a channel-shaped cross-section formed by a second side wall with parallel second flanges extending inwardly therefrom. The relative sizes of the first and second frame components are such that there exists a marginal space therebetween. This marginal space is occupied by an intermediate filler piece having its inner edge connected to the first side wall of the inner first frame component and its outer edge held between and decoratively overlapped by the second flanges of the outer second frame component.

Preferably, the inner edge of the filler piece is provided with locking ears which protrude inwardly into apertures in the first side wall, thereby establishing a convenient and secure interlocking relationship between these two components.

The outer edge of the intermediate filler piece is preferably provided with an upturned lip which fits tightly beneath one of the second flanges on the outer second frame component.

Again preferably, the intermediate filler piece is covered by a decorative planar piece arranged between the aforesaid upturned lip and the first wall of the inner first frame component.

These features, as well as other objects and advantages of the invention will be more clearly understood from the following description and the accompanying drawings, both of which refer to preferred but non-limiting embodiments of the invention.

DESCRIPTION OF ILLUSTRATED EMBODIMENTS

Figure 1:
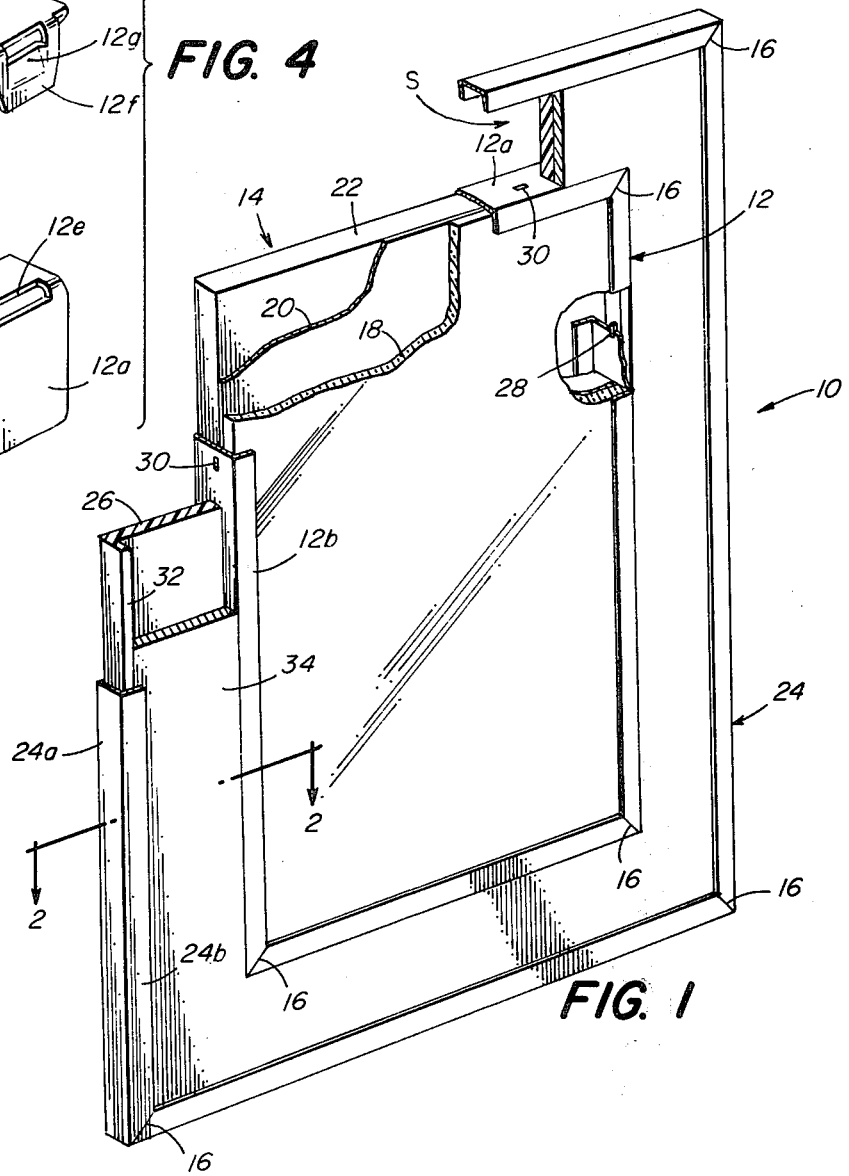
FIG. 1 is a perspective view with portions broken away of one embodiment of an expanded composite picture frame in accordance with the present invention.

One embodiment of an expanded composite picture frame is generally depicted at 10 in FIG. 1. The frame 10 includes an inner first frame component 12 surrounding a display opening 14. The first frame component 12 has a channel-shaped cross-section formed by a first side wall 12*a* with parallel first flanges 12*b*, 12*c* extending inwardly therefrom.

Figure 4:
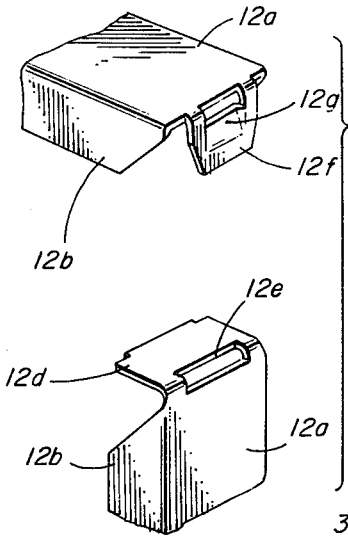

The frame component 12 preferably is fabricated in a single continuous length, with the flanges 12*b*, 12*c* being appropriately notched to provide mitered corners 16. When the frame component is bent into the straight-sided configuration illustrated in the drawings, the opposite ends of the frame component 12 may be joined by any conventional means, an example of which is illustrated in FIG. 4 as comprising a tongue 12*d* at one end having a receiving slot 12*e* therein, and another tongue 12*f* at the opposite end dimensioned to be received in slot 12*e* and having a detent 12*g* arranged to interlock behind tongue 12*d*.

Although not shown, it will be understood that the rear flange 12*c* as well as a portion of the first side wall 12*a* are relieved in order to accommodate slidable insertion of the following conventional components in the display opening 14: a front transparent protective panel 18 of glass, plexiglass or other like material; a picture 20; and, one or more appropriate planar filler piece 22.

It will be understood that the term "picture" as herein employed is intended to encompass not only typical photographs, snapshots and the like, but also any other documentary-type materials conventionally displayed in frames of the type herein under consideration.

An outer second frame component 24 surrounds the inner first frame component 12. The second frame component 24 is likewise provided with a channel-shaped cross-section formed by a second side wall 24*a* with parallel second flanges 24*b*, 24*c* extending inwardly therefrom. The second frame component also is preferably fabricated as a single continuous length which is notched at intervals to form mitered corners 16, with its ends being interconnected by the means typically illustrated in FIG. 4. The relative sizes of the first and second frame components 12, 24 are such that there exists a marginal space "s" therebetween.

The space "s" is occupied by a planar intermediate filler piece 26. The inner edge of filler piece 26 is connected to the first side wall 12*a* and the outer edge of the filler piece 26 is decoratively overlapped by the outer second frame component 24.

Preferably, the filler piece 26 has integrally formed locking ears 28 protruding inwardly into appropriately positioned slots or apertures 30 in the first side wall 12*a*. The locking ears 28 and the apertures 30 cooperate in providing an interlocking relationship which securely holds the first frame component 12 along the inner edge of the filler piece 26. It will be understood that the first frame component 12 is preferably fabricated of light gauge metal with sufficient inherent resiliency to permit it to be snapped into place in the display opening 14 within the confines of the filler piece 26.

The outer edge of the filler piece 26 is preferably provided with an upturned lip 32. Although the lip 32 is illustrated as being continuous around the entire periphery of the filler piece, it can if desired be discontinuous in order to conserve material. The vertical dimension of the lip 32 combined with the thickness of the filler piece 26 is such that the top edge of the lip 32 is held tightly beneath the flange 24*b* on the outer frame component 24. Also, the back peripheral surface of the filler piece 26 is tightly contained beneath the other flange 24*c* on the second frame component 24. The net result is a tight fit achieved by assembling the outer frame component 24 around the outer periphery of the filler piece 26.

Figure 2:
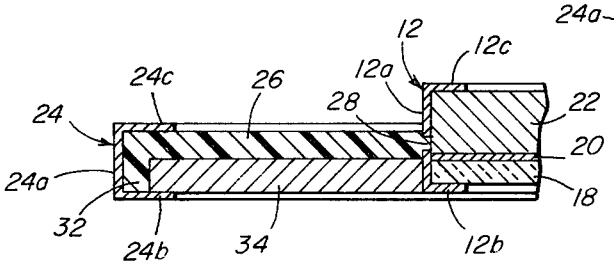
FIG. 2 is a sectional view on an enlarged scale taken along lines 2—2 of FIG. 1.

In the preferred embodiment of the invention shown in FIGS. 1 and 2, the front surface of the filler piece 26 is covered by an additional planar decorative piece 34. The inner edge of the piece 24 is arranged to abut against the first side wall 12*a*, and the outer edge of piece 26 is arranged to be tightly overlapped by the flange 24*b* which also overlaps the top edge of the upturned lip 32.

Figure 3:
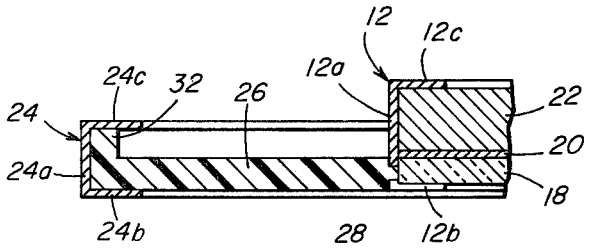
FIG. 3 is a sectional view similar to FIG. 2 showing an alternate embodiment of the invention; and, FIG. 4 is a partial perspective view illustrating a typical means for interlocking the ends of the frame components.

Under certain circumstances, it may be desirable to eliminate the additional decorative piece 34. This can be accomplished by reversing the intermediate filler piece 26 as shown in FIG. 3.

In light of the foregoing, it will now be appreciated by those skilled in the art that the present invention provides a novel and improved expanded composite picture frame embodying a number of significant advantages. For example, assembly of the picture frame can be accomplished entirely by hand without the need of special tools, jigs, fixtures and the like. Nails, screws and other like fasteners are not required. Once assembled, all of the frame components are securely interlocked in a tight assembly characterized by structural rigidity and a neat appearance, with all functional fastening and interlocking elements hidden from view.

Typically, the inner and outer frame components 12, 24 will be fabricated from a light-gauge highly polished metal, whereas the filler piece 26 and the additional decorative piece 34 will be fabricated of different materials. Typically, piece 26 will be molded from a commercially available plastic. The piece 26 may be either transparent, translucent or opaque, the only requirement being adequate rigidity. The additional decorative piece 34 need not be particularly rigid since it is adequately supported by the filler piece 26. Hence, piece 34 may comprise a more delicate material such as a thin layer of cork, or a relatively thin paper covered by silk, velour or the like. These examples are merely illustrative of the wide range of materials and fabrics which may be employed to produce highly decorative frames in a wide variety of ornamental motifs.

It is our intention to cover all changes and modifications to the invention herein chosen for purposes of disclosure which do not depart from the spirit and scope of the invention.

We claim:

1. An expanded composite picture frame comprising: an inner first frame component surrounding a display opening, said first frame component having a channel-shaped cross-section formed by a first side wall with parallel first flanges extending inwardly therefrom; means cooperating with said first frame component to retain a picture in said display opening; an outer second frame component surrounding said first frame component, said second frame component having a channel-shaped cross-section formed by a second side wall with parallel second flanges extending inwardly therefrom, the relative sizes of said first and second frame components being such that there exists a marginal space therebetween; and planar intermediate means for filling said marginal space, the inner edge of said intermediate means having inwardly protruding locking ears, said first side wall having apertures for receiving said locking ears, the outer edge of said intermediate means being firmly gripped and decoratively overlapped by said second frame component.

2. The expanded composite picture frame of claim 1 wherein the outer edge of said planar intermediate means is provided with an upturned lip held tightly beneath one of said second flanges.

3. The expanded composite picture frame of claim 2 further comprising a planar decorative piece overlying said planar intermediate means, the inner edge of said decorative piece being arranged to abut said first side wall, and the outer edge of said decorative piece being overlapped by the same first flange which overlaps said upturned lip.

4. An expanded composite picture frame comprising: a planar intermediate panel having an inner edge surrounding a display opening and an outer edge with an upturned lip integrally formed therewith; an inner first frame component for supporting a picture in said display opening, said first frame component having a first side wall abutting said inner edge with parallel first flanges extending inwardly from said first side wall into said display opening; cooperating means on said intermediate panel and said first frame component for locating and retaining said first frame component in said display opening, said cooperating means consisting of locking ears on said intermediate panel and apertures on said first side wall for receiving said locking ears; and an outer second frame component decoratively covering said outer edge and said upturned lip.

5. The expanded composite picture frame of claim 4 wherein said locking ears are formed integrally with and protrude inwardly from said inner edge.

6. The expanded composite picture frame of claim 5 wherein said outer second frame component comprises a second side wall abutting said outer edge, with parallel second flanges extending inwardly from said second side wall, said intermediate panel and said upturned lip being overlapped by and held between said second flanges.

7. The expanded composite picture frame of claim 6 further comprising a decorative piece overlying said intermediate panel, the inner and outer edges of said decorative piece abutting respectively said first side wall and said lip, said decorative piece being partially overlapped by one of said second flanges.

* * * * *